United States Patent [19]

Takihara

[11] 4,398,784

[45] Aug. 16, 1983

[54] JACK ASSEMBLY STRUCTURE

[75] Inventor: Yukio Takihara, Kaizuka, Japan

[73] Assignee: Hosiden Electronics Co., Ltd., Osaka, Japan

[21] Appl. No.: 276,495

[22] Filed: Jun. 23, 1981

[51] Int. Cl.[3] ..... H01R 13/70

[52] U.S. Cl. ..... 339/182 R

[58] Field of Search ..... 339/182 R, 183

[56] References Cited

U.S. PATENT DOCUMENTS 2,717,367 9/1955 Puerner ..... 339/183

3,435,163 3/1969 Bailey et al. ..... 339/183 X

*Primary Examiner*—Eugene F. Desmond

*Attorney, Agent, or Firm*—Steele, Gould & Fried

[57] ABSTRACT

The present application discloses a jack assembly structure in which at least one contact piece is formed in a rectangular plate having parallel outer pieces projected from the two opposite sides thereof and parallel inner pieces projected from the other two opposite sides thereof, each of said inner pieces having a width smaller than the facing distance of the outer pieces, and such contact piece is mounted to the opening of a box-type jack case, with the inner surfaces of the both outer pieces contacted with the outer surfaces of the both lateral walls of the jack case and the both lateral edges of the inner pieces contacted with the inner surfaces of the both lateral walls of the jack case, whereby the both lateral walls of the jack case is pressingly held and reinforced by the contact piece.

7 Claims, 5 Drawing Figures

JACK ASSEMBLY STRUCTURE

BACKGROUND OF THE INVENTION

The present invention relates to a jack assembly structure in which a plurality of contact pieces are mounted in a box-shape jack case after being inserted into the openings thereof.

There is conventionally known a jack assembly structure of the type above-mentioned, in which a contact piece is mounted into a jack case with the both lateral edges of the contact piece pressingly inserted into grooves in the inner surfaces of the both lateral walls of the jack case.

With recent developments of subminiature electric appliances of every sort such as a radio set and a cassette tape recorder, there is increased a demand for a smaller and thinner jack case for a jack to be used in such subminiature electric appliance.

According to the conventional jack assembly structure mentioned earlier, however, when the peripheral walls of the jack case are formed thin, there is a possibility of the jack case being deformed due to a press-insertion force of the contact piece or heat required for dip brazing of the contact piece. It is therefore difficult to design such conventional jack having a contact piece insertingly mounted to a jack case, in a smaller size using a thin jack case so as to be applied to a subminiature electric appliance.

SUMMARY OF THE INVENTION

It is an object of the present invention to provide a small-size jack assembly structure in which the peripheral walls of a jack case are formed thin, while preventing the jack case from being deformed by influences of a press-insertion force of the contact piece or heat required for dip brazing of the contact piece.

In order to achieve the object above-mentioned, the jack assembly structure in accordance with the present invention has at least one contact piece in a peculiar shape, which is formed in a rectangular plate having parallel outer pieces projected from the two opposite sides thereof and parallel inner pieces projected from the other two opposite sides, each of the inner pieces having a width smaller than the facing distance of the parallel outer pieces. Such contact piece is mounted to the opening of a jack case, with the inner surfaces of the outer pieces contacted with the outer surfaces of the lateral walls of the jack case and the both lateral edges of the inner pieces contacted with the inner surfaces of the lateral walls of the jack case.

According to such assembly structure, the both lateral walls of the jack case are pressingly held by the inner pieces and the outer pieces of the contact piece, thereby to prevent the jack case from being deformed outwardly and inwardly by the outer pieces and the inner pieces of the contact piece, respectively. Therefore, the peripheral walls of such jack case can be formed thin without any risk of deformation of the jack case.

It is another object of the present invention to provide a jack assembly structure in which mounting of contact pieces to the jack case can be rigidly and securely performed.

In order to achieve the object above-mentioned, throughbores are formed in the outer pieces of the contact piece and engagement claws are formed on the outer surfaces of the lateral walls of the jack case, said engagement claws being engaged with said throughbores with the use of resiliency of the contact piece material.

Furthermore, the jack case has, at the inner surfaces of the lateral walls thereof, four guide grooves into which the lateral edges of the inner pieces of the contact piece are fittingly inserted.

BRIEF DESCRIPTION OF THE DRAWINGS

The present invention will be further described, by way of example, with reference to the accompanying drawings, in which.

DESCRIPTION OF THE PREFERRED EMBODIMENT

Figure 1:
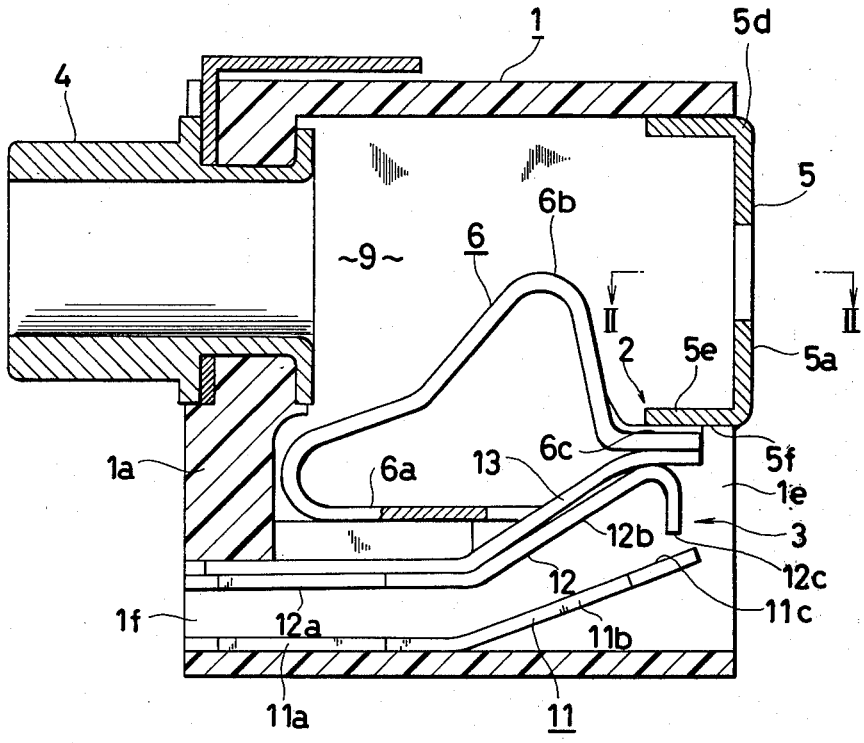
FIG. 1 is a section view, with portions broken away, of jack assembly structure in accordance with the present invention.

With reference to FIG. 1, a jack case 1 houses first and second contact switches 2 and 3. The jack case 1 made of a synthetic resin has an open back and is formed in a box shape. The jack case 1 is provided at the front wall 1*a* thereof with a plug insertion sleeve 4.

The first contact switch 2 comprises a fixed contact piece 5 and a movable contact piece 6, and is of the normally closed type. The fixed contact piece 5, made of a good conductive material, has outer pieces 5*b* and 5*c* projected from the two opposite sides or both lateral edges of a rectangular portion 5*a* of the contact piece 5, and has inner pieces 5*d* and 5*e* projected from the other two opposite sides or upper and lower edges of the rectangular portion 5*a*. The lower surface of the lower inner piece 5*e* is formed as a contact portion 5*f*.

Figure 2:
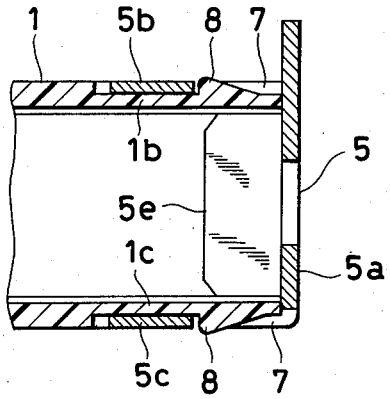
FIG. 2 is a section view, with portions broken away, taken along the line II—II in FIG. 1.
Figure 3:
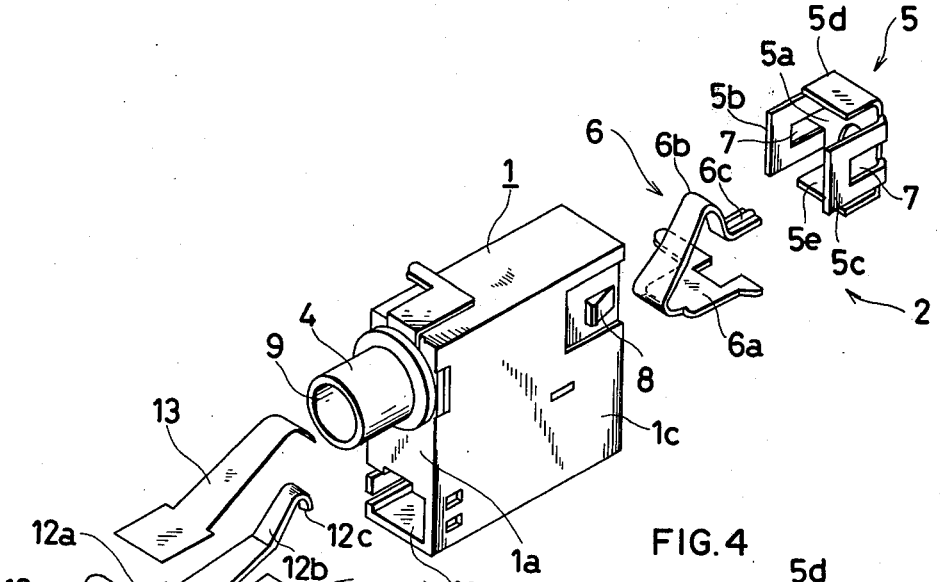
FIG. 3 is a disassembled perspective view of the jack assembly structure of the present invention.
Figure 4:
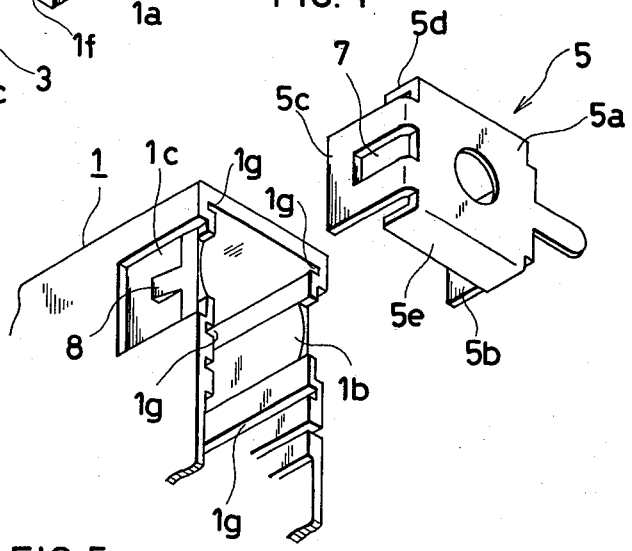
FIG. 4 is a perspective view of a contact piece and a jack case viewed from the back side thereof, with portions broken away.
Figure 5:
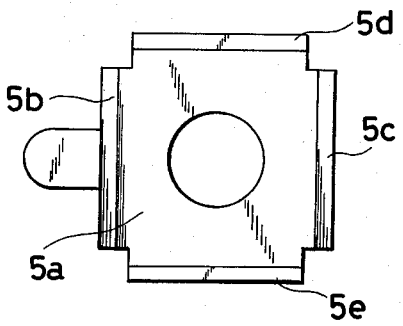
FIG. 5 is a front view of the contact piece.

The fixed contact piece 5 is attached to the jack case 1 in such a manner that the fixed contact piece 5 is pressed to the back opening of the jack case 1 while resiliently engaging engagement claws 8 formed on the outer surfaces of the lateral walls 1*b* and 1*c* of the jack case 1 with throughbores 7 formed in the outer pieces 5*b* and 5*c*. Thus, the inner surfaces of the outer pieces 5*b* and 5*c* come in contact with the outer surfaces of the lateral walls 1*b* and 1*c* of the jack case 1, and the both lateral edges of the inner pieces 5*d* and 5*e* come in contact with the inner surfaces of the lateral walls 1*b* and 1*c*. As shown in FIG. 2, the lateral walls 1*b* and 1*c* are held by the outer pieces 5*b* and 5*c* and the inner pieces 5*d* and 5*e* of the fixed contact piece 5.

Formed in the lateral walls 1*b* and 1*c* are guide grooves 1*g* into which the inner pieces 5*d* and 5*e* of the fixed contact piece 5 are fittingly inserted.

The movable contact piece 6 has a rectangular plate 6*a*, a tongue 6*b* turned from the front edge thereof in the upward and rearward direction, and a contact 6*c* formed at the tip of the tongue 6*b*, the rectangular plate 6*a* pressingly inserted into the back opening 1*e* of the jack case 1 and secured to the jack case 1. The contact 6*c* comes in contact with the contact 5*f* of the fixed contact piece 5, and the tongue 6*b* is located in the course of a plug insertion path 9.

The second contact switch 3 comprises a fixed contact piece 11 and a movable contact piece 12, and is of the normally open type. The movable contact piece 12 is located under and adjacent the movable contact piece 6 of the first contact switch 3, through an insulator 13 for example an insulating film.

The fixed contact piece 11 and the movable contact piece 12 respectively have rectangular plates 11*a* and 12*a*, tongues 11*b* and 12*b* rearwardly extended from the rear edges thereof, and contacts 11*c* and 12*c* formed at the tips of the tongues 11*b* and 12*b*, the rectangular plates 11*a* and 12*a* pressingly inserted into the front opening 1*f* of the jack case 1 and secured to the jack case 1.

With such arrangement, when a plug (not shown) is inserted into the plug insertion path 9, the movable contact piece 6 of the first contact switch 2 is pressed and downwardly rotated by the plug, so that the contact 6*c* of the movable contact piece 6 is separated from the contact 5*f* of the fixed contact piece 5, whereby the contact switch 2 is switched to the OFF-state. Thus downwardly rotated movable contact piece 6 presses downwardly the movable contact piece 12 of the second contact switch 3 through the insulating film 13. The movable contact piece 12 is then downwardly rotated, so that the contact 12*c* of the movable contact piece 12 comes in contact with the contact 11*c* of the fixed contact piece 11, whereby the contact switch 3 is switched to the ON-state.

It is a matter of course that the means of securing the fixed contact piece 5 to the jack case 1 is not limited to one discussed hereinbefore. For example, engagement claws may be formed on the contact piece, and concaves or holes for engaging with such engagement claws may be formed in the jack case.

What is claimed is:

1. A jack assembly structure comprising:

a box-shaped jack case;

a plurality of contact pieces mounted in the jack case, at least one of said contact pieces being a rectangular plate having parallel outer pieces projecting from two opposite sides thereof and parallel inner pieces projecting from the other two opposite sides thereof, each of said inner pieces having a width smaller than the distance between said outer pieces, and said at least one contact piece being mounted to said openings of said jack case such that inner surfaces of said outer pieces are disposed against outer surfaces of the lateral walls of said jack case, and lateral edges of said inner pieces are disposed against inner surfaces of said lateral walls.

2. The jack assembly structure of claim 1, wherein at least one of the outer pieces of said contact piece and the lateral walls of the jack case are bored through, and the other has engagement claws, said engagement claws spaced to engage said at least one of the outer pieces and the lateral walls.

3. The jack assembly structure of claims 1 or 2, wherein the inner surfaces of the lateral walls of the jack case have four guide grooves into which the lateral edges of the inner pieces of said at least one contact piece are fittingly inserted.

4. A jack assembly comprising:

two opposite walls defining an open end;

a contact plate inserted into the open end, the contact plate engaging the opposite walls, the contact plate having a body disposed across the open end, and first and second pairs of tabs extending perpendicularly from the body of the contact plate, the first pair of tabs being inserted into the open end, edges of the first pair of tabs engaging inner faces of the opposite walls, and the second pair of tabs enclosing the two opposite walls at the open end, facing surfaces of the second pair of tabs engaging outer faces of the two opposite walls, whereby the jack case is reinforced by action of the contact plate gripping the opposite walls between the edges and faces of the first and second pairs of tabs, respectively.

5. The jack assembly of claim 4, wherein the contact plate and the walls are locked by interfitting engagement means thereupon, the interfitting engagment means disposed between the opposite walls of the jack assembly and the second pair of tabs of the contact plate.

6. The contact plate of claim 4, wherein the two opposite walls defining the open end are grooved on facing portions thereof, the first pair of tabs of the contact plate slidably fitting edgewise in the grooves.

7. The contact plate of claim 5, wherein the two opposite walls defining the open end are grooved on facing portions thereof, the first pair of tabs of the contact plate slidably fitting edgewise in the grooves.

* * * * *